US006981754B2

(12) United States Patent
Godil et al.

(10) Patent No.: US 6,981,754 B2
(45) Date of Patent: Jan. 3, 2006

(54) INK DELIVERY AND PRINTING METHOD FOR PHASING PRINTING SYSTEMS

(75) Inventors: Amin M. Godil, Vancouver, WA (US); Larry E. Hindman, Woodburn, OR (US); Amy B. Thornton, Tigard, OR (US)

(73) Assignee: Xerox Corporation, Stamford, CT (US)

( * ) Notice: Subject to any disclaimer, the term of this patent is extended or adjusted under 35 U.S.C. 154(b) by 205 days.

(21) Appl. No.: 10/749,289

(22) Filed: Dec. 30, 2003

(65) Prior Publication Data

US 2005/0140705 A1 Jun. 30, 2005

(51) Int. Cl.
*B41J 29/38* (2006.01)

(52) U.S. Cl. ..... 347/17; 347/88

(58) Field of Classification Search ..... 347/17
See application file for complete search history.

(56) References Cited

U.S. PATENT DOCUMENTS 5,386,224 A * 1/1995 Deur et al. ..... 347/7

6,447,084 B1 * 9/2002 Uetsuki et al. ..... 347/7

* cited by examiner

*Primary Examiner*—David Gray
*Assistant Examiner*—Laura E. Martin
(74) *Attorney, Agent, or Firm*—Fay, Sharpe, Fagan, Minnich & McKee, LLP

(57) ABSTRACT

A method and system is provided for more accurately determining ink in-flow and out-flow to a reservoir in a solid-to-liquid ink phasing delivery system for supplying ink to a printer. The printer throughput is safely maximized with a software algorithm that measures the ink available in the printer reservoir for printing. The algorithm is based on the known amount of ink in the reservoir when a level sensor probe is tripped and then calculates additional changes in ink volume. The process is done until the algorithm determines the reservoir volume is below a predetermined minimum level when the level sense probe senses ink. The algorithm calculates the ink leaving the reservoir using an out-flow model based on pixel counting and calculates ink entering the reservoir using an in-flow model based on a minimum guaranteed amount of ink delivered from the melt heater. A time out period is further calculated in which the reservoir should be refilled, and if not, the system is checked for an ink stick jam.

15 Claims, 5 Drawing Sheets

INK DELIVERY AND PRINTING METHOD FOR PHASING PRINTING SYSTEMS

BACKGROUND

The present exemplary embodiments relate to printing systems and, in particular, printing devices which utilize a supply of colored inks to be communicated to a print head for document printing. More particularly, the present embodiments utilize solid ink sticks as the supply ink, which must be heated to a liquid form before being capable of communication to the print head. Such systems are commercially available under the PHASER® mark from Xerox Corporation.

The present embodiments concern the structure, control system and operation methods of the heater element for causing a phase change in the solid ink supply to a liquid form capable of fluid communication to a print head for document printing.

The basic operation of such phasing print systems comprises the melting of a solid ink stick, its communication to a reservoir for interim storage, and then a supply process from the reservoir to a print head for printing of a document. One object of the control strategy is to avoid the printing system running out of ink while trying to print, because such an event can be a catastrophic failure to the system. Prior known systems will typically supply a measuring device in the reservoir to monitor ink levels therein. When the ink drops below a certain level due to normal usage, then the ink supply control system would melt more of the solid ink supply until the reservoir would refill to the desired level. The steps of asking for more ink, turning on the heater to melt the solid ink, delivering the ink to the reservoir to a desired level and then turning the heater off is commonly referred to as an "ink melt duty cycle."

Conventional systems used a fixed applied power supply to the heater that was intended to provide a desired melt rate for the ink into a reservoir that was relatively large (approximately twenty-two grams of ink could be held therein). The ink level detector would initiate an ink melt duty cycle when the measuring device indicated that the ink level had dropped below a predetermined level. In the situation where an ink stick jam has occurred, i.e., the solid ink stick is obstructed from sliding down the ink loader tray to engagement with the heater, the continued supply of energy to the heater would not be able to melt the solid ink stick, because the stick was spaced from the heater itself. If the reservoir were to actually run dry, the printing system would suffer a catastrophic failure and would be unable to print. In addition, the continued application of the power to the elements of the heater could cause high temperature damage to the heater itself and to adjacent componentary. The print head could become clogged requiring an expensive maintenance repair with significant printer down time.

In order to avoid the possibility of running out of ink after it had dropped below a certain level in the reservoir, conventional systems employed a timer which would time out after a preselected amount of time that was assumed would not be enough time to let the reservoir run out, even for maximum printing usage of that color. If the measuring device did not indicate a refill of the reservoir during the time out period, the controller would disable the application of energy to the heater, thus assuming an ink stick jam. The system would disable further printing and heating after the elapse of the timer time-out cycle. This time out was calculated as the number of seconds of usable ink remaining in the reservoir based on the print image and mode that uses the maximum amount of ink. After the time out, the software would disallow printing until the ink level in the reservoir increased and was sensed by the ink level sense probe. Since the time out is based on the maximum possible ink usage, the printer was frequently not allowed to print which caused the printing rate to fall below specifications. Lastly, after the time out, the ink stick jam could then be identified and corrected, and the reservoir would then have to be refilled before printing could recommence.

The present exemplary embodiments are intended to employ a smaller reservoir of approximately five to six grams of ink. Smaller reservoirs present an advantage of not having to heat larger ink portions to remain liquid in the print head. In a maximum fill printing operation, the smaller reservoirs can be drained relatively quickly so that a time-out operation before assessing an ink stick jam presents an unacceptable risk of a reservoir going dry and consequential damage to the print head and the jets therein. There is a need for a system which can provide a more accurate indication of an ink stick jam to provide for improved operating control of system operation and improved safety against a catastrophic failure of a dried out reservoir occurring during a print operation. There is also a need for more efficiency in controlling the melt duty cycle to improve the overall printing rate. The present exemplary embodiments satisfy these needs as well as others to provide an improved method and assembly for detecting an ink stick jam in a phasing printing system. However, it is to be appreciated that the present exemplary embodiments are also amenable to other like applications where the supply of power to the heating element needs to be interrupted relatively soon due to the failure to supply an item intended to be heated by the heater element.

BRIEF DESCRIPTION

Printer throughput is safely maximized with a software algorithm that estimates the ink available in the print head reservoir for printing. This algorithm is based on the known amount of ink in the reservoir when the level sense probe is tripped and then calculates additional changes in ink volume. This process is done until the algorithm determines that the reservoir volume is below a predetermined minimum level or when the level sense probe senses ink. The algorithm calculates the ink leaving the reservoir using an out-flow model based on pixel counting and calculates the ink entering the reservoir using an in-flow model based on a minimum guaranteed amount of ink delivered from the melt heater.

A method and system is provided for controlling an ink melt heater in a solid-to-liquid ink phasing delivery system for supplying ink to a printer. The phasing system includes a heater disposed to engage a solid ink stick and heat an engaging portion of ink stick to a liquid phase for communication to a reservoir associated with a print head. The reservoir includes an ink level detector. A controller selectively supplies a predetermined amount of power to the heater. The ink level detector measures an amount of liquid ink in the reservoir. When the amount of liquid ink is measured to be at a predetermined level, the controller calculates an amount of ink thereafter delivered from the reservoir for printing. When the calculating indicates that the amount of ink delivered from the reservoir approximates an amount of ink stored therein at the predetermined level, and the level detector indicates that the ink in the reservoir remains above the predetermined level, the controller halts the supply of power to the heater. The calculating preferably comprises counting pixels printed by the printer with ink from the reservoir. Additionally, the controller can time the period during which the ink in the reservoir is below the predetermined level and can compare that timing with an estimated time for refilling the reservoir to the predetermined level with a minimum guaranteed amount of ink delivered from the melt heater. When the comparing indicates that the amount of ink in the reservoir should have been refilled to the predetermined level, and the measuring indicates that the ink in the reservoir still remains below the predetermined level, the controller halts the supply of power to the heater and the delivery system is checked for an ink stick jam.

DETAILED DESCRIPTION

Figure 1:
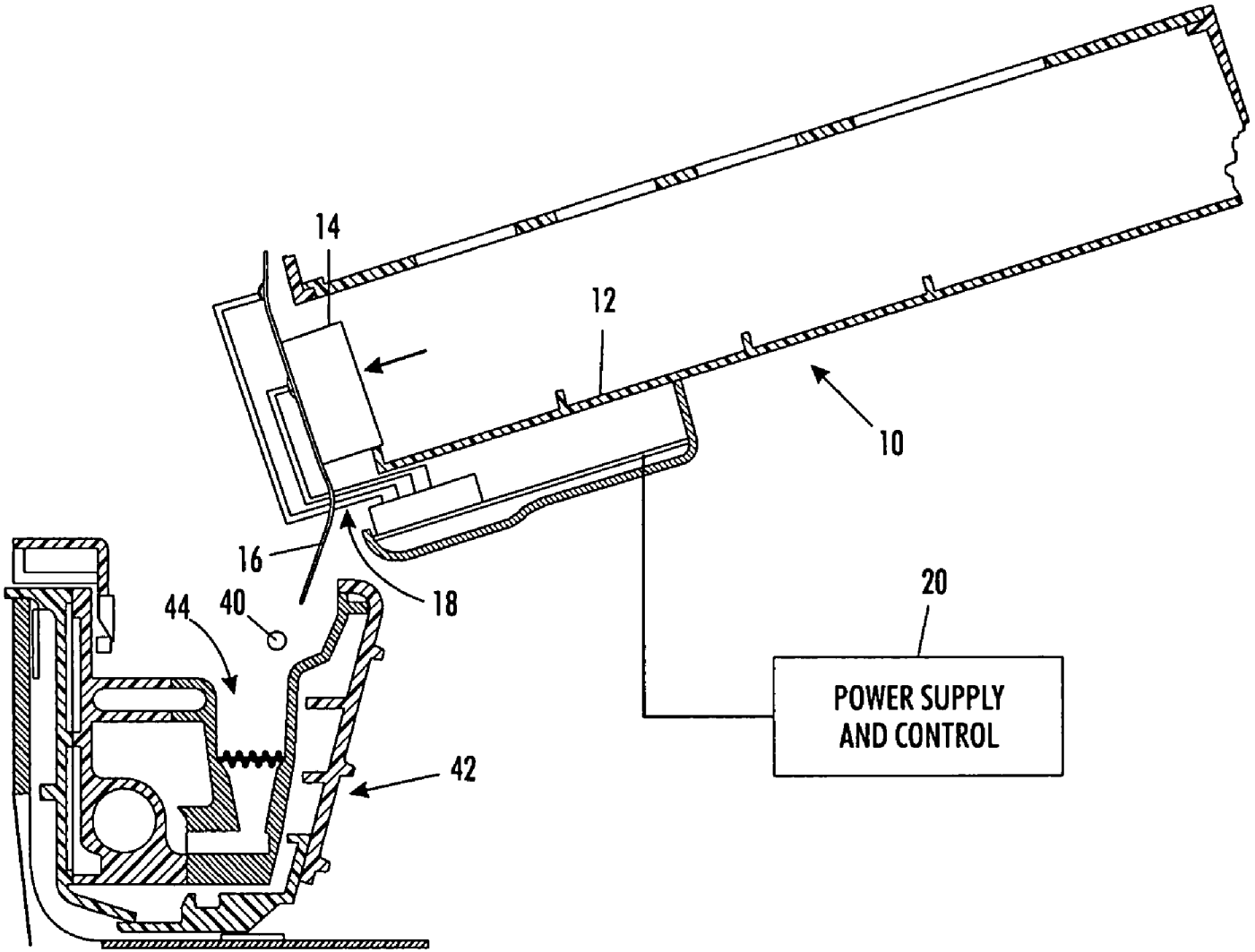
FIG. 1 is a cross-sectional view in partial section of a print head, ink stick and ink loader assembly, and power supply and control system therefor.

With reference to FIG. 1, the basic elements of an ink supply system in an ink "phase-changing" printing system can be seen. Ink loader assembly 10 includes a tray 12 for holding a solid phase ink stick 14. An ink melt heater 16 is disposed at an open end 18 of the tray to contact a proximate portion of the ink stick and to allow for egress of liquid phase ink during heating from the tray 10. The heating plate 16 receives its heating energy from a power supply and control system 20. The heating element includes an assembly with resistance traces thereon so that electrical energy supplied thereto can be converted to heat energy.

FIG. 1 is intended to illustrate an accurate positional disposition of the ink stick in the tray 11 to illustrate that the ink stick is urged against the heater plate 16 by both gravity and some other applied force means such as a spring bias (not shown) or the like. If, as the ink stick 14 is urged towards the heating plate 16, some obstruction causes it to be unable to slide into engaging contact, the heater plate 16 can rise to a temperature substantially in excess of the desired melt rate temperature due to the absence of a cooling effect of a melting ink stick against it.

Ink stick jams can occur due to the cracking of the ink stick itself over time and the falling of particles from the stick on to the glide surfaces of the tray 12. Alternatively, the stick 14 could somehow be moved out of the track path or become skewed in the path to limit its ability to slide down the tray. The door (not shown) which allows the refilling of a solid ink stick into the tray could be detached and also could obstruct the ink stick's movement. Other causes could be dirt falling into the tray or any other causes of friction between the tray glide surface and the stick. However, whatever the cause, the failure of the ink stick to engage the heater plate 16 can cause overheating damage to the plate, and when such a lack of ink supply causes the print head assembly to run out of ink, the failure can be catastrophic.

FIG. 1 shows an ink drip 40 falling from the tray 10 and the heating element 16 assembly from ink drip point 36 into a print head assembly 42. Print head assembly 42 comprises a reservoir 44 to receive the melted ink and to communicate with the ink through nozzles (not shown) within the print head assembly for printing on a document. The reservoir is intended to hold approximately five to six grams of melted ink and is accordingly heated to maintain the ink stored therein in liquid form.

Figure 2:
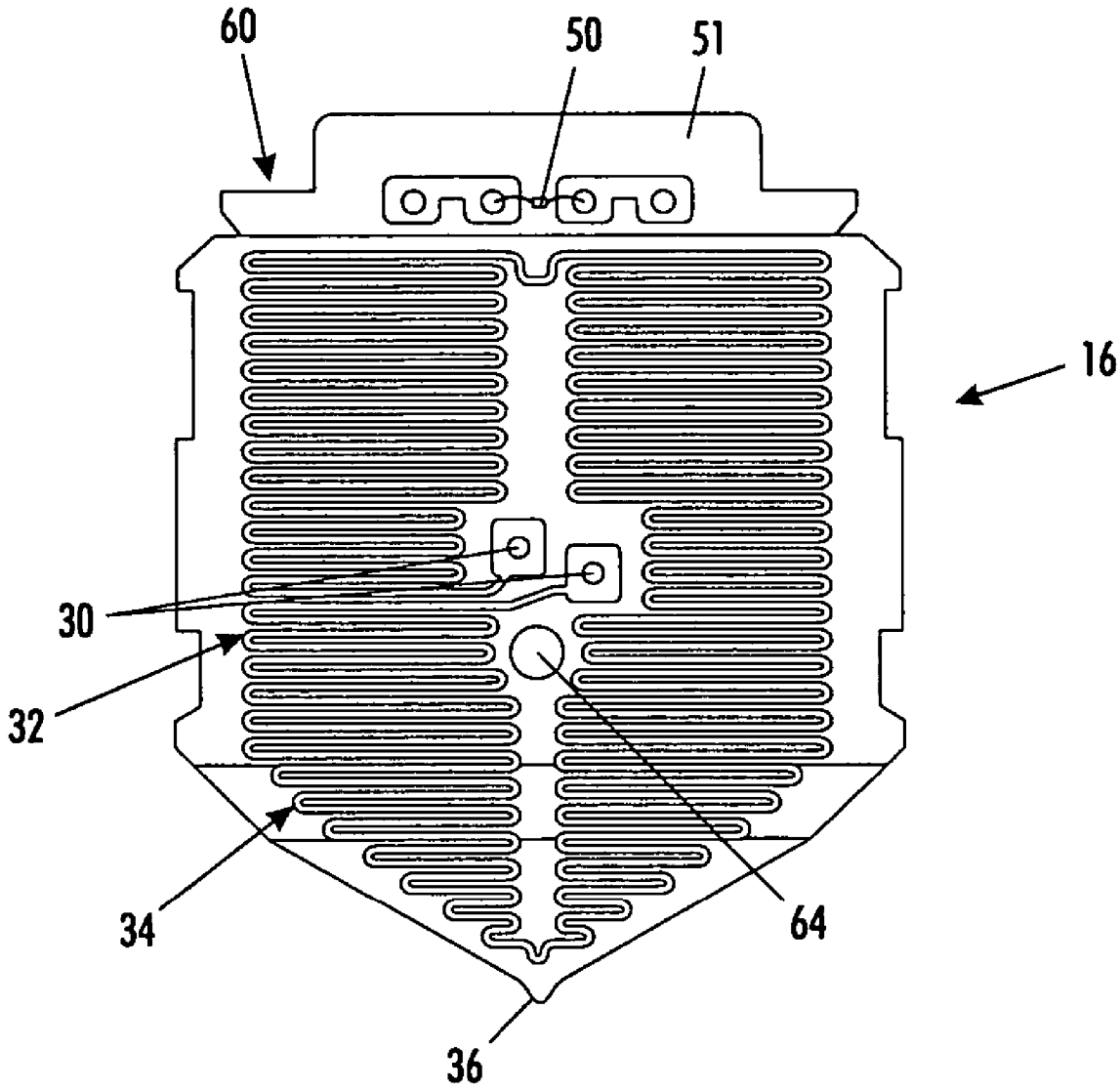
FIG. 2 is an end view of one embodiment of a heater melt plate.

With particular reference to FIG. 2, power pads 30 connectwires (not shown) from the power supply to the heating plate 16. The plate includes a first portion 32 disposed to engage the ink stick and phase change the solid ink stick to a liquid. A heated liquid ink zone 34 then allows the liquid ink to flow to an ink drip point 36. It should be appreciated that the embodiment shown in FIG. 2 comprises the side of the heater element having the heat traces shown. The ink stick will actually contact the element comprising a metallic heat plate on a back side from that shown in FIG. 2. A rivet hole 38 is used to attach the assembly of heat traces to the metallic plate. A temperature sensing device 50 is associated with the heating plate 16 for detecting a temperature thereof. Although numerous temperature sensing devices are available, such as thermometers, electrical sensors, chemical sensors, or the like, in this presently preferred embodiment a thermistor 50 mounted on a depending portion 51 and in direct communication with the control system 20 effectively detects a signal representative of the temperature of the heater.

The present preferred embodiment comprises an algorithm that monitors the amount of ink in the reservoir 44 to accomplish the overall objective of controlling the heater 16 to provide ink to the print head 42, but also implement such overall control in an intelligent method which tracks the amount of usable ink in the reservoir 44 and provides an ink jam detection system to reliably maximize printing speed and avoid print head ink starvation. The present embodiment comprises an improved algorithm to significantly improve the printer controller's knowledge of the ink level in the print head reservoir, which reduces the amount of time that printing is disallowed, thereby increasing printing speed. The algorithm also prevents starvation in the print head caused by an inadequate ink level in the reservoir 44.

Figure 3:
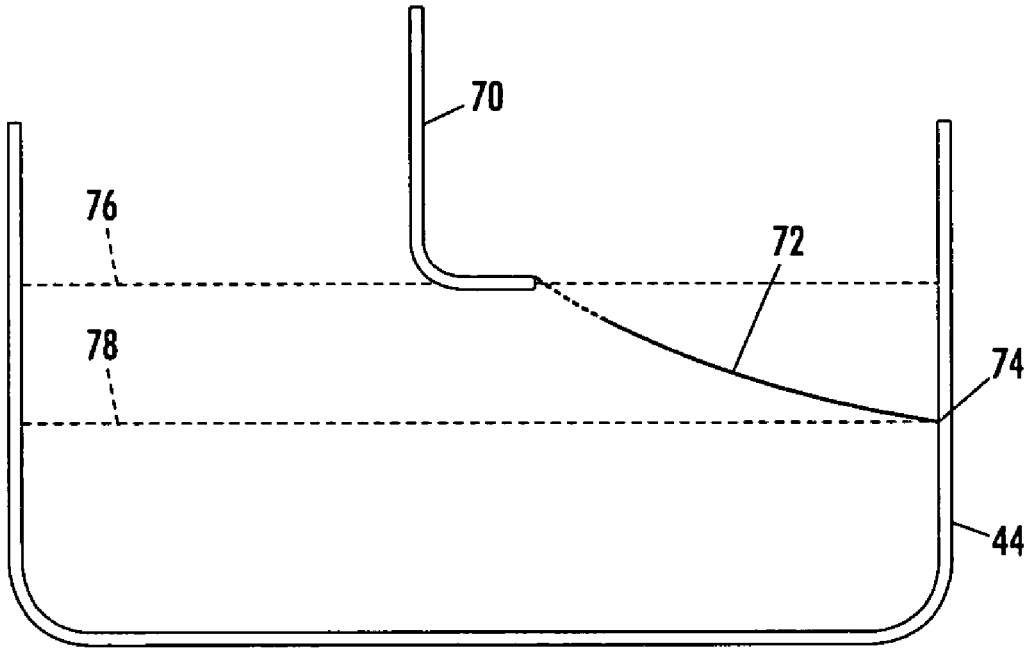
FIG. 3 is a diagramatic view of a print head reservoir including an ink level sense detector.

With particular reference to FIG. 3, a diagramatic view of a reservoir 44 shows an ink level detector 70 of the type that measures ink level by a closed circuit wherein an ink meniscus line 72 extending between the detector 70 and the side wall 74 of the reservoir forms a closed circuit. When the meniscus 72 snaps to form an open circuit, the controller 20 knows that the ink has fallen to a certain level. More particularly, the detector 70 indicates two ink levels within the reservoir 44. The first level indicated by line 76 is the position of the detector 70 within the reservoir 44. A second level 78 represents an ink level at which the meniscus 72 is likely to snap as the ink level continues to fall from the reservoir. In particular, in the present embodiment, the reservoir is assumed to hold approximately 6 grams of ink when the ink volume is at least at the level indicated by line 76. The maximum meniscus volume, i.e., the ink volume between level 76 and 78, is about 1.8 grams and the nominal volume of ink when the meniscus snaps, i.e., the volume below level 78, is approximately 3.3 grams. Accordingly, in a printing operation, as ink is supplied from the reservoir to the print head, the ink volume will continue to flow out until the level detector indicates an open circuit, at which point the controller 20 will consider that the remaining usable volume of ink in each reservoir in the system is approximately 3.3 grams. Upon refilling, with melted ink supplied from the heater, the detector 70 will not function as part of a closed circuit until ink volume has risen again to level 76, i.e., approximately 6 grams. In addition, the control strategy of the present embodiments assumes corrections for nominal volume variances comprising reservoir cavity tolerances, printer tilt or level sense tolerances.

Figure 4:
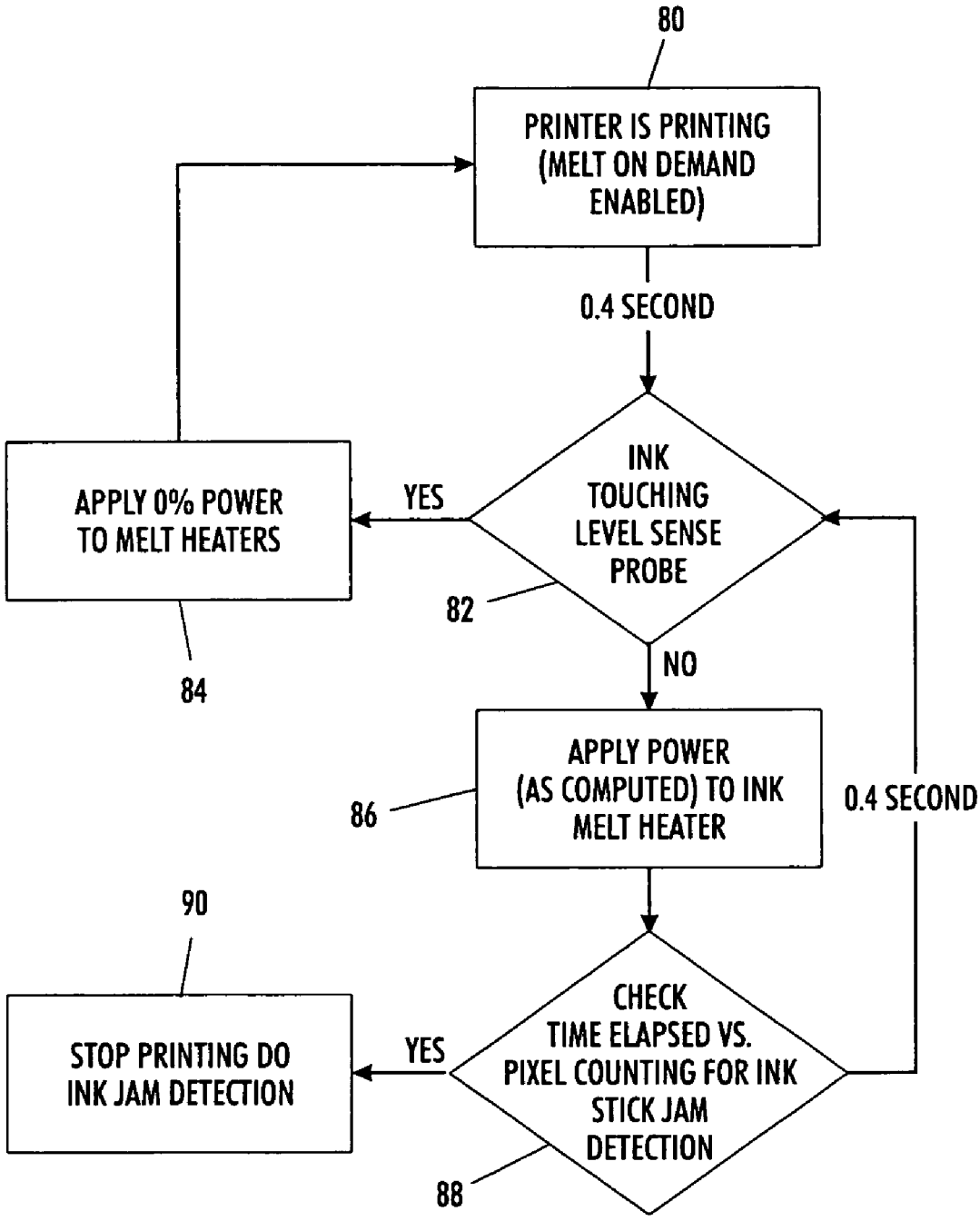
FIG. 4 is a flow chart illustrating the overall operating steps of heater control in one embodiment.

With particular reference to FIG. 4, an overall general control strategy for controlling ink flow into the reservoir is shown. As the printer is performing a print job 80, there is no need to initiate a melt duty cycle by applying power to the heater while the ink is touching 82 the detector 70 indicating that the volume of ink in the reservoir is at least the nominal usable volume (i.e., 3.3 grams). The selective applying of power to the heaters based upon detected volume of ink in the reservoir 40 is referred to as a "melt-on-demand" operation. When the printing has depleted the volume of ink in the reservoir to below the nominal usable volume, i.e., the meniscus no longer forms a closed circuit with the sensor 70, power is supplied 86 to the heater 16 to cause an ink in-flow into the reservoir 44. While printing during the melt duty cycle, the control strategy is to calculate the approximate volume of ink in the reservoir by assuming a preselected amount of in-flow into the reservoir from the heater and by monitoring the amount of ink flow out of the reservoir by counting the number of pixels printed with ink from that reservoir. If the ink in-flow from the melting, less the out-flow for the printing, does not refill the reservoir within a certain amount of time determined to be appropriate for the refill, then the controller 20 stops the print job and indicates that a detection should be made for an ink jam within the loader tray. FIG. 4 indicates that the inquiries made at steps 82 and 88 are accomplished every 0.4 seconds, for essentially a continuous monitoring of system operation.

Figure 5:
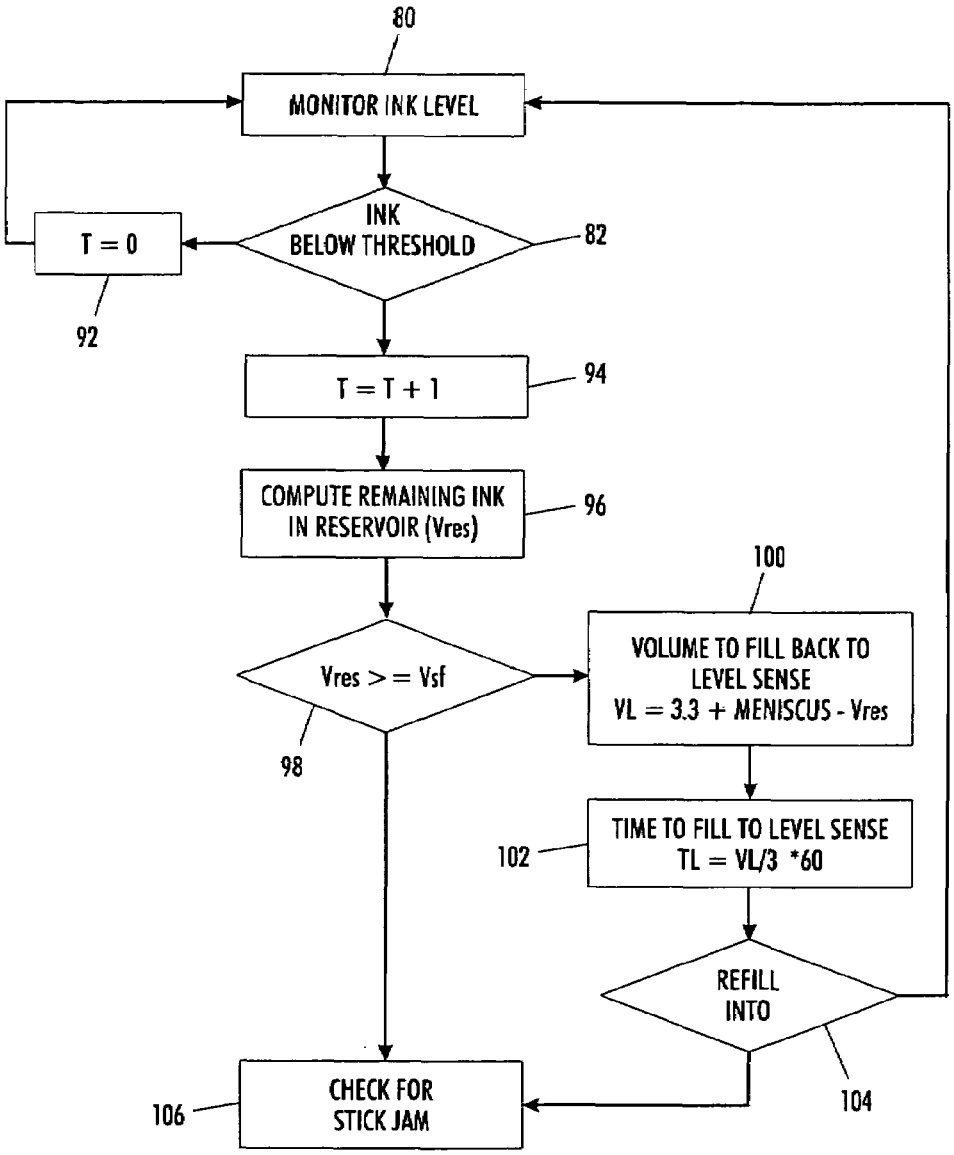
FIG. 5 is a flow chart for particularly illustrating the control steps for ink stick jam detection using a variable timer with printer pixel counting.

With reference to FIG. 5, a more detailed flow chart for monitoring ink in-flow versus out-flow over a limited time is shown.

After printing every single page in a print job and before printing the next page of the job, the controller 20 needs to be satisfied that there is enough ink in the print head to complete the printing of that page.

$$\text{Print If(Minimum ink volume+Ink in-flow−Ink out-flow)>ink mass of 100\% fill print} \quad (1)$$

By "100% fill print" is meant the amount of ink which would be drawn from a reservoir if all of the jets for that reservoir were printing continuously for the entire page. A single page 100% fill print is thus considered the reservoir ink safety margin. As noted above, the prior art system of having a fixed timer based on the highest possible ink out-flow and the lowest reservoir volume heavily penalizes the print speed of a user who might have light fill jobs, which is the majority of users for most jobs. The subject embodiment therefore satisfies the demand for a printing and ink delivering algorithm that optimizes the print speed for the majority of the users and avoids catastrophic ink starvation failures.

As noted above, the maximum meniscus ink volume is approximately 26% of the print head reservoir volume, or about 1.8 grams in a 6 grams reservoir. Certain compensating factors, such as printer tilting and tolerance factors for the reservoir capacity and the level sense probe are also included as adjustments when considering the usable volume of ink in accordance with the present embodiments. The following equation defines the maximum available volume of ink as used in the subject algorithm and which comprises the nominal volume of the reservoir (approximately 6 grams) minus the maximum meniscus volume (approximately 1.8 grams) and minus certain selected tolerance factors (1.5×RSS (RSS represents reservoir cavity tolerances, printer tilt factors and level sense probe tolerances). Accordingly, the available ink can be represented by the following equation:

$$\text{Mavail_for_pixel_ct=nom_usable_vol−meniscus−(1.5×RSS (reservoir cavity, printer tilt, level sense probe)} \quad (2)$$

Pixel counting starts after time zero 92 (FIG. 5) and the timer increments 94 to calculate 96 the ink in the reservoir 44. "Time zero" is defined as the event in the print head when ink in the reservoir 44 drops below the level sense probe 70, i.e., level 78, snapping the ink meniscus 72. At time zero, a minimum guaranteed volume of ink is present. Ink usage accounting comprising the ink used in the printing process is deducted from this minimum volume. In the exemplary embodiment described above, the ink volume in the reservoir at time zero should be about 3.3 grams and from this volume at time zero, the volume out ($V_o$) for printed pixels is subtracted.

After a print job has been completed, real time ink jetting data is available. This data includes a number of pixels printed of each color. Total volume used of each color can be calculated by using the maximum drop mass and subtracting totals from the estimated volume of ink for each color's reservoir channel. The print head would usually have three different color channels. The maximum drop mass is calculated by taking a preselected drop size for the print head and adding an adjustment factor to account for variation in drop size caused by life of the print head and dither (for example, 11.5% volume may be added). After the job has been printed, the volume of ink in the reservoirs is updated based on actual pixels printed in accordance with the following equation:

$$\text{New volume of ink=old volume−[(pixels printed of that color)×(maximum dropmass)]} \quad (3)$$

Additionally, prior to allowing a print job, the system ensures that there is adequate ink volume in the reservoir 44 to print a page. Since ink volume used per print is only available after a job has been printed, the printer must make certain that enough ink is present in each of the four reservoir channels for a single color print at 100% fill prior to allowing any print job. The paper size and print type is available in the preprint command. Using that information the algorithm calculates a maximum ink potentially required for the given print type at maximum drop mass, i.e., the volume of ink in the reservoir, Vres must be greater than or equal to the volume required for safely completing the job, $V_{sf}$. The "type" of print job is important for example because transparencies are dual pass and may use twice as much ink as paper print. If there is not enough ink in the reservoir for a "highest demand" print, the subject algorithm does not allow printing until the ink level reaches the ink level sense probe 70, i.e., level 76 in reservoir 44. When the ink reaches this level, the ink loader has melted enough ink to refill the reservoir channel and the minimum mass available for pixel counting is reset. Accordingly, after this system has calculated 100, the volume of ink in the reservoir left after the pixel counting process, a time is computed 102 necessary to fill the reservoir up to the probe, i.e., level 76. A predetermined minimum amount of ink is assumed to flow into the reservoir from the heater for this refill process. If the refill does not occur 104 within the minimum time ($T_a$) so computed, the system will check for an ink jam 106.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A method of controlling an ink melt heater in a solid to liquid ink phasing delivery system for supplying ink to a printer, wherein the phasing system includes a heater disposed to engage a solid ink stick and heat an engaging portion of the ink stick to a liquid phase for communication to a reservoir associated with a print head, the reservoir including an ink level detector, and a controller for selectively supplying power to the heater plate, the method comprising:

supplying a predetermined amount of power through the controller to the heater for melting the ink stick to liquid ink for filling the reservoir;

measuring with the ink level detector an amount of liquid ink in the reservoir;

when the amount of liquid ink is measured to be at a predetermined level, calculating thereafter an amount of ink delivered from the reservoir for printing; and, when the calculating indicates that the amount of ink delivered from the reservoir approximates an amount of ink stored therein at the predetermined level and the level detector indicates that the ink in the reservoir remains below the predetermined level thereby indicative of an ink stick jam, halting the supplying of power to the heater.

2. The method as claimed in claim 1 wherein the calculating comprises counting pixels printed by the printer with ink from the reservoir.

3. The method as claimed in claim 1 wherein if during the calculating the measuring indicates that the ink in the reservoir has refilled to more than the predetermined level, halting the calculating.

4. The method as claimed in claim 1 wherein upon the halting of the supplying of power, checking the delivery system for an ink stick jam.

5. The method as claimed in claim 1 further including timing the calculating and comparing the timing with a calculated time for refilling the reservoir to the predetermined level with the melting of the ink stick less the delivered ink for printing, and wherein when the comparing indicates that the amount of ink in the reservoir should have been refilled to the predetermined level and the measuring indicates that the ink in the reservoir remains below the predetermined level, initiating the halting of the supplying of power and checking the delivery system for an ink stick jam.

6. The method as claimed in claim 5 wherein the comparing includes assuming a preselected inflow of ink from the heater.

7. The method as claimed in claim 6 wherein the assuming comprises assuming three grams per minute as the inflow of ink.

8. A method for detecting an ink stick jam in a solid to liquid ink phasing delivery system for supplying ink to a printer for a print job, wherein the phasing system includes a heater disposed to engage a solid ink stick and heat an engaging portion of the ink stick to a liquid phase at a desired melt rate for communication to an ink reservoir associated with a print head of the printer and a controller for selectively supplying power to the heater and for determining an amount of ink used by the print head during printing of the print job, and wherein an ink level detector is disposed for determining an amount of ink in the reservoir, the method comprising:

powering the heater to effect the desired melt rate for filling the reservoir;

determining the amount of ink in the reservoir during the printing of the print job;

when the determined amount falls below a certain level, calculating the amount of ink remaining in the reservoir during the print job by subtracting therefrom the amount of ink used by the print head during the print job;

when the calculated amount of ink is determined to be less than a preselected amount for safely completing the print job, halting the print job;

affording a preselected time for refilling the reservoir to the certain level by the powering of the heater and upon elapse of the preselected time without the refilling to the certain level, halting the powering of the heater; and, after halting the powering, detecting whether the ink stick jam has occurred.

9. The method as defined in claim 8 wherein the calculating comprises counting pixels printed by the printer with ink from the reservoir.

10. The method as defined in claim 8 wherein when during the calculating, the determining the amount of ink in the reservoir determines that the reservoir has refilled to the certain level, halting the calculating.

11. The method as defined in claim 8 wherein the affording includes assuming a preselected inflow of ink by the powering of the heater.

12. A printing apparatus including a solid to liquid phasing delivery system for supplying ink to a print head, wherein the delivery system includes means for detecting when the supply of ink to the print head is inhibited by an ink stick jam, comprising:

a heater disposed to engage the solid ink stick and melt a proximate portion of the ink stick to a liquid phase;

a reservoir disposed to receive the liquid phase ink and communicate the ink upon demand to the print head, the reservoir including means for detecting an amount of ink therein;

a controller in communication with the heater, reservoir and print head for controlling the supply of ink through the apparatus by halting heater melting upon the detecting of an ink level in the reservoir at a certain level and after calculating further reservoir depletion from continued printing by the print head with ink from the reservoir while continuing to detect an absence of refilling of the reservoir to the certain level for a preselected period of time, whereby the absence is indicative of the ink stick jam.

13. The printing apparatus as claimed in claim 12 wherein the controller calculates that the depletion comprises an unsafe risk of print head ink starvation before completion of a print job by the printing apparatus.

14. The printing apparatus as claimed in claim 12 wherein the controller calculates reservoir depletion by counting pixels printed by the printer with the ink from the reservoir.

15. The printing apparatus as claimed in claim 14 wherein the controller further calculates an inflow of ink to the reservoir with the depletion by counting pixels.

* * * * *